United States Patent [19]

Suzuki et al.

[11] Patent Number: 4,542,093

[45] Date of Patent: Sep. 17, 1985

[54] PHOTOGRAPHIC SILVERHALIDE MATERIAL CONTAINING TWO SUBBING LAYERS

[75] Inventors: Tamotsu Suzuki; Sumio Nishikawa; Sumitaka Tatsuta, all of Shizuoka, Japan

[73] Assignee: Fuji Photo Film Co., Ltd., Kanagawa, Japan

[21] Appl. No.: 634,518

[22] Filed: Jul. 26, 1984

[30] Foreign Application Priority Data

Jul. 26, 1983 [JP] Japan ..... 58-136338
Jul. 29, 1983 [JP] Japan ..... 58-138959

[51] Int. Cl.[4] ..... G03C 1/78

[52] U.S. Cl. ..... 430/523; 430/531; 430/536; 430/537; 430/538

[58] Field of Search ..... 430/271, 523, 538, 531, 430/536, 537

[56] References Cited

U.S. PATENT DOCUMENTS

| | | | |
|---|---|---|---|
| 2,027,688 | 1/1936 | Hagendon | 430/531 |
| 2,362,580 | 11/1944 | Nadeau et al. | 430/536 |
| 2,541,478 | 2/1951 | Nadeau et al. | 430/536 |
| 2,670,288 | 2/1954 | Smith | 430/531 |
| 2,694,639 | 11/1954 | Nadeau et al. | 430/531 |
| 2,977,331 | 3/1961 | Ericks | 430/538 |
| 2,992,104 | 7/1961 | Haas | 430/531 |
| 3,368,891 | 2/1968 | Laenen | 430/538 |
| 3,669,709 | 6/1972 | Kasugai et al. | 430/538 |
| 3,775,160 | 11/1973 | Clachan et al. | 430/534 |
| 4,220,471 | 9/1980 | Data et al. | 430/538 |
| 4,283,486 | 8/1981 | Aono et al. | 430/538 |

*Primary Examiner*—Jack P. Brammer
*Attorney, Agent, or Firm*—Sughrue, Mion, Zinn, Macpeak, and Seas

[57] ABSTRACT

A photographic material comprising a hydrophobic support is described, having thereon a first subbing layer formed of a polymeric compound and a second subbing layer comprising a hydrophilic layer containing water-soluble methyl cellulose having a degree of substitution less than 2.5 or water-soluble polyvinyl alcohol having a degree of hydrolysis less than 97 mole % on the first subbing layer.

19 Claims, No Drawings

PHOTOGRAPHIC SILVERHALIDE MATERIAL CONTAINING TWO SUBBING LAYERS

FIELD OF THE INVENTION

This invention relates to photographic materials, and more particularly to a photographic material having a photographic layer composed of a hydrophilic colloid on a support having a hydrophobic surface.

BACKGROUND OF THE INVENTION

Hitherto, as a photographic support, polyethylene terephthalate, cellulose triacetate, polystyrene, polycarbonate, polyolefin laminated papers, etc., have frequently been used owing to the excellent transparency, flexibility, etc.

However, in the case of using such polymers as the support, it has been very difficult to strongly adhere a photographic layer composed of a hydrophilic colloid comprised mainly of gelatin to the support, since the support has a hydrophobic surface. For overcoming such difficulty, the following surface treatment methods of the hydrophobic support have hitherto been practiced:

(1) Methods involving a surface activation treatment such as a chemical treatment, a mechanical treatment, a corona discharging treatment, a flame treatment, an ultraviolet treatment, a high frequency wave treatment, a glow discharging treatment, an active plasma treatment, a laser treatment, a mixed acid treatment, an ozone oxidation treatment, etc., have been applied to the surface of the support, followed by coating directly thereon a photographic emulsion, whereby good adhesion is obtained, and (2) Methods involving applying a surface activation treatment as above-described to the surface to the support, then forming a subbing layer thereon, and thereafter coating a photographic emulsion layer on the subbing layer.

Such methods are described, for example, in U.S. Pat. Nos. 2,698,241; 2,764,520; 2,864,755; 3,143,421; 3,462,335; 3,475,193 and 3,615,556; U.K. Patent Nos. 788,365; 804,005; 891,469, etc. Among the above-described methods, methods of type (2) are more effective and widely employed.

It is considered that in these surface treatments, the adhesive power of the surface is increased due to polar groups, more or less, being formed on the surface of the support, which is originally hydrophobic; a thin layer giving negative effect for the adhesion of the polar surface is removed; the crosslinkage density on the surface of the support is increased to increase the bonding strength, etc. It is also considered that as a result of the above effect, the affinity with the polar groups of the components contained in the coating composition for the subbing layer is increased, and the fastness of the adhered surface is also increased.

Also, various attempts have been practiced as a method of coating a subbing layer on a support. For example, there are a so-called double layer method wherein a layer adhering well to a support is formed as a first layer, and then a hydrophilic resin layer is formed thereon as a second layer, and a single layer method wherein only one resin layer containing both a hydrophobic group and a hydrophilic group is formed on a support by coating.

These methods have been well investigated. For example, the aptitudes of copolymers formed using a monomer selected from vinyl chloride, vinylidene chloride, butadiene, methacrylic acid, acrylic acid, itaconic acid, maleic anhydride, etc., and various resins such as polyethyleneimine, epoxy resin-grafted gelatin, nirtocellulose, etc., have been investigated as is disclosed in U.S. Pat. Nos. 3,501,301, 3,271,178.

In particular, for performing a subbing method of obtaining a sufficient adhesive power capable of enduring practical use between a hydrophobic support and a hydrophilic silver halide emulsion in a complete aqueous system, a vinylidene chloride copolymer and a dienic copolymer has been investigated.

As a method of adhering a support and a silver halide emulsion layer, the inventors previously found that a copolymer containing a dienic monomer as a component is effective for a coating composition of a subbing layer solely or with a proper crosslinking agent as described, for example, In Japanese Patent Application (OPI) Nos. 114,12/76; 94,025/79 and 65,949/80 (The term "OPI" as used herein refers to a "published unexamined Japanese Patent Application").

It is thus well known that a hydrophilic material such as gelatin or a gelatin derivative is coated on a base support having a subbing layer for obtaining a good adhesive power with a photographic emulsion layer. In such cases if the support is allowed to stand in a state such that the subbing layers are in contact with each other, a so-called "blocking phenomenon" is liable to occur, and this tendency is particularly remarkable under high humidity and high pressure. As a method of preventing the occurrence of the blocking phenomenon, there is a method of coating a subbing layer on a support, and coating further, before winding the support, a second subbing layer composed of gelatin containing a hardening agent such as formaldehyde, etc., or a matting agent, and then winding the support. Also as a method of preventing the occurrence of blocking without using the second subbing solution, there is a method described in Japanese Patent Application (OPI) No. 119,919/'77 wherein the thickness of the subbing layer is limited to arange of from 0.25 to 1.0 micron, and synthetic polymer particles having a mean particle size of from 0.1 to 10.0 microns and a glass transition temperature of higher than 45° C. are incorporated in the layer as a type of matting agent.

However, these methods have the following various disadvantages. First, the film loses its transparency to some extent, which also reduces the quality of the photographic product. Second, in the steps from drying to winding of the support after coating thereon a subbing layer containing a matting agent, and in the steps of coating the support with a photographic hydrophilic organic colloid layer such as a silver halide photographic emulsion layer to winding of the photographic film, the matting agent is transferred onto rolls which are brought into contact with the support. Third, during coating and drying of the subbing layer, the matting agent existing in the subbing solution forms nuclei and makes heterogeneous the properties of the subbing solution, such as surface tension, etc., which results in causing pin hole-like foam or stains, thus reduce the commercial value as a photographic film support. Fourth, when photographic films thus prepared are stored under high humidity (higher than 60% RH) and high pressure (higher than 1 kg/cm$^2$), a sufficient blocking prevention effect is not obtained. These disadvantages occur by the presence of the matting agent in both the cases of a single layer coating and a double layer coating.

As a method of not using a matting agent, there is a method of incorporating a hardening agent in the second layer, but this method also has disadvantages, since the photographic properties are significantly influenced by the kind and amount of the hardening agent incorporated in the layer, the adhesion with a silver halide emulsion layer (which is the original purpose of a subbing layer) becomes insufficient, and the blocking prevention effect is insufficient. Thus, such method is not effective for practical purposes.

SUMMARY OF THE INVENTION

The present invention has been accomplished in order to overcom the problems of the conventional techniques.

A first object of this invention is to prevent blocking of photographic materials without reducing the adhesion of the support and silver halide photographic emulsion layers and without adverse influences on the photographic properties.

A second object of this invention is to prevent the occurrence of blocking of layers between a subbing layer for a backing layer and a silver halide photographic emulsion layer, or blocking of layers between a subbing layer for a silver halide photographic emulsion layer and a backing layer. In the case of forming the photographic hydrophilic organic colloid layer such as a silver halide photographic emulsion layer and a backing layer on the subbing layer.

A third object of this invention is to provide a blocking prevention method without the occurrence of aggregation and sedimentation in a subbing liquid and without forming pinhole and unevenness on the support coated with a subbing layer.

A fourth object of this invention is to provide a photographic material having on a support uniform coatings as subbing layers without adverse influences on the transparency of the support.

A fifth object of this invention is to provide a photographic material showing an excellent blocking prevention effect when the support having subbing layers coated thereon is allowed to stand for a long period of time under high humidity and high pressure conditions.

A sixth object of this invention is to provide a photographic material having subbing layers showing a good coating property of photographic silver halide emulsion layers.

A seventh object of this invention is to provide a blocking prevention method without staining pass rolls in the subbing step and the silver halide emulsion coating step.

Thus, according to this invention, a photographic material is provided comprising a hydrophobic support having thereon a first subbing layer composed of a polymeric material and second subbing layer comprising a hydrophilic layer containing a water-soluble methyl cellulose having a substitution degree of less than 2.5 or water-soluble polyvinyl alcohol having a degree of hydrolysis of less than 97 mole% on the first subbing layer.

There are no particular restrictions on the structure of the polymeric material coated on the hydrophobic support in this invention, but the polymeric material is homopolymer or copolymer and it is preferred that the glass transition temperature of the polymeric material be in the range of from −20° C. to 40° C. When the first subbing layer further contains a dichloro-s-triazine derivative and/or an electrolyte, more desirable effects are obtained.

According to this invention, it becomes possible to prevent the occurrence of blocking of photographic materials, which has hitherto been impossible without using a matting agent or a hardening agent, without reducing the desired properties of a subbing layer and without adverse influences on the photographic properties. On the other hand, in this invention, a matting agent is not used, and hence the above-described disadvantages which accompany the use of a matting agent are eliminated, as well as attaining the prevention of blocking, without using any matting agent.

DESCRIPTION OF THE PREFERRED EMBODIMENTS

The invention is explained in more detail below.

The hydropholic support in this invention is films of, for example, a cellulose ester (in particular, cellulose triacetate, cellulose diacetate, cellulose propionate, etc.,), polyamide, polycarbonate, a polyester (in particular, polyethylene terephthalate, poly-1,4-cyclohexanedimethylene terephthalate, polyethylene-1,2-diphenoxyethane-4,4'-dicarboxylate, etc.,), polystyrene, polypropylene, polyethylene, etc., and composite films formed by coating or laminating these films on papers or other supports.

Among the above-described films, a polyethylene terephthalate film is most perferably used, and, in particular, a polyethylene terephthalate film which was biaxially oriented and thermally fixed is advantageously used from the points of stability, toughness, etc.

There are no particular restriction on the thickness of the plastic film support, but a thickness of form about 15 to 500 microns, and preferably from 40 to 200 microns, is useful from the view points of ease of handling, broad applicability, etc.

Also, the support may be transparent or may contain a dye, a pigment such as titanium dioxide, silicon dioxide, alumina sol, chromium salts, zirconium salts, etc.

As the polymeric material coated on the hydrophobic support in this invention, copolymers of dienic monomers are preferably used.

A preferred copolymer of a dienic monomer is a copolymer composed of a dienic monomer having 4 to 8 carbon atoms, such as butadiene, isoprene, etc., as a component of the copolymer.

Examples of comonomers to be copolymerized with the dienic monomer include vinyl or vinylidene compounds having 2 to 8 carbon atoms, such as styrene, acrylonitrile, acryl esters, methacryl esters (methyl, ethyl, butyl, propyl, etc.,), vinyl ethers (methyl, ethyl, chloroethyl, butyl, etc.,), vinyl esters (e.g., vinyl acetate, vinyl propionate, etc.,), glycidyl acrylate, glycidyl methacrylate, allyl glycidyl ether, dimethylaminoethyl methacrylate, vinylpyridine, tert-butylaminoethyl methacrylate, acrylic acid, methacrylic acid, crotonic acid, itaconic acid, itaconic acid half ester, maleic acid, maleic acid half ester, itaconic anhydride, maleic anhydride, allyl alcohol, 2-hydroxyethyl methacrylate, 2-hydroxyethyl acrylate, 2-hydroxypropyl methacrylate, 2-hydroxypropyl acrylate, monoallyl ethers of polyhydric alcohols, acrylamide, methacrylamide, maleinamide, N-methylolacrylamide, N-methylolmethacrylamide, the esters of them, vinyl isocyanate, allyl isocyanate, etc.

The dienic copolymers are preferably prepared by an emulsion polymerization method, and are commercially available. The proportion of the diene component in the copolymer is generally from about 30 to 60% by weight, and preferably from 32 to 40% by weight, based on the total weight of the copolymer.

Also, the copolymer may contain a monomer having a hydrophilic moiety, such as amide group, hydroxy group, carboxy group, etc., in an amount of from 0.1 to 20% by weight.

Particularly preferred polymeric materials which are useful for the first subbing layer in this invention include homopolymers and copolymers having a glass transition temperature in the range of from −20° C. to 40° C. Examples of monomers used for the preparation of such copolymers or homopolymers are acrylic acid esters, acrylamides, methacrylic acid esters, methacrylamides, allyl compounds, vinyl ethers, vinyl esters, vinyl heterocyclic compounds, N-vinyl compounds, styrenes, crotonic acids, itaconic acids, olefins, maleic anhydrides, etc. Practical examples of these monomers are acrylic acids such as acrylic acid, acrylates (e.g., ethyl acrylate, propyl acrylate, butyl acrylate, amyl acrylate, ethylhexyl acrylate, octyl acrylate, t-octyl acrylate, 2-methoxyethyl acrylate, 2-butoxyethyl acrylate, 2-phenoxyethyl acrylate, chloroethyl acrylate, hydroxyethyl acrylate, cyanoethyl acrylate, hydroxypropyl acrylate, dimethylaminoethyl acrylate, 2,2-dimethylhydroxypropyl acrylate, 5-hydroxypentyl acrylate, diethylene glycol monoacrylate, trimethylolpropane monoacrylate, pentaerythritol monoacrylate, glycidyl acrylate, 2-hydroxy-3-chloropropyl acrylate, benzyl acrylate, methoxybenzyl acrylate, furfuryl acrylate, tetrahydrofurfuryl acrylate, phenyl acrylate, etc.,); methacrylic acrylic acids such as methacrylic acid, methacrylates (e.g., methyl methacrylate, ethyl methacrylate, propyl methacrylate, isopropyl methacrylate, amyl methacrylate, hexyl methacrylate, cyclohexyl methacrylate, benzyl methacrylate, cyanoacetoxyethyl methacrylate, chlorobenzyl methacrylate, octyl methacrylate, sulfopropyl methacrylate, N-ethyl-N-phenylaminoethyl methacrylate, ethylene glycol monomethacrylate, 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate, diethylene glycol monomethacrylate, trimethylolpropane monomethacrylate, pentaerythritol monomethacrylate, glycidyl methacrylate, 2methoxyethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, etc.,); acrylamides such as acrylamide, N-substituted acrylamides (e.g., methylacrylamide, ethylacrylamide, propylacrylamide, isopropylacrylamide, butylacrylamide, t-butylacrylamide, heptylacrylamide, t-octylacrylamide, cyclohexylacrylamide, benzylacrylamide, hydroxymethylacrylamide, methoxyethylacrylamide, dimethylaminoethylacrylamide, hydroxyethylacrylamide, phenylacrylamide, hydroxyphenylacrylamide, tolylacrylamide, naphthylacrylamide, dimethylacrylamide, diethylacrylamide, dibutylacrylamide, diisobutylacrylamide, diacetoneacrylamide, methylbenzylacrylamide, benzyloxyethylacrylamide, β-cyanoethylacrylamide, acryloylmorpholine, N-methyl-N-acryloylpiperazine, N-acryloylpiperidine, acryloylglycine, N-(1,1-dimethyl-3-hydroxybutyl)acrylamide, N-β-morpholinoethylacrylamide, N-acryloylhexamethyleneimine, N-hydroxyethyl-N-methylacrylamide, N-2-acetamidoethyl-N-acetylacrylamide, etc.,); methacrylamides such as methacrylamide, N-substituted methacrylamides (e.g., methylmethacrylamide, t-butylmethacrylamide, t-octylmethacrylamide, benzylmethacrylamide, cyclohexylmethacrylamide, phenylmethacrylamide, dimethylmethacrylamide, diethylmethacrylamide, dipropylmethacrylamide, hydroxyethyl-N-methylmethacrylamide, N-methyl-N-phenylmethacrylamide, N-ethyl-N-phenylmethacrylamide, etc.,); allyl compounds such as allyl esters (e.g., allyl acetate, allyl caproate, allyl caprylate, allyl laurate, allyl palmitate, allyl stearate, allyl benzoate, allyl acetoacetate, allyl lactate, etc.,), allyloxy ethanol, allyl butyl ether, allyl glycidyl ether, allyl phenyl ether, etc.; vinyl ethers (e.g., methyl vinyl ether, vinyl butyl ether, hexyl vinyl ether, octyl vinyl ether, decyl vinyl ether, ethylhexylvinyl ether, methoxyethyl vinyl ether, ethoxyethyl vinyl ether, chloroethyl vinyl ether, 1-methyl-2,2-dimethylpropyl vinyl ether, 2-ethyl butyl ether, hydroxyethyl vinyl ether, diethylene glycol vinyl ether, dimethylaminoethyl vinyl ether, diethylaminoethyl vinyl ether, butylaminoethyl vinyl ether, benzyl vinyl ehter, tetrahydrofurfuryl vinyl ether, vinyl phenyl ether, vinyl tolyl ether, vinyl chlorophenyl ether, vinyl-2,4-dichlorophenyl ether, vinyl naphthyl ether, vinyl anthranyl ether, etc.,); vinyl esters such as vinyl acetate, vinyl propionate, vinyl butyrate, vinyl isobutyrate, vinyl dimethylpropionate, vinyl ethyl butyrate, vinyl valerate, vinyl caproate, vinyl chloroacetate, vinyl dichloroacetate, vinyl methoxyacetate, vinyl butoxyacetate, vinyl phenylacetate, vinyl acetoacetate, vinyl lactate, vinyl-β-phenyl butyrate, vinylcyclohexyl carboxylate, vinyl benzoate, vinyl salicylate, vinyl chlorobenzoate, vinyl tetrachlorobenzoate, vinyl naphtoate, etc.; vinyl heterocyclic compounds such as N-vinyloxazolidone, vinylpyridine, vinylpicoline, N-vinylimidazole, N-vinylpyrrolidone, N-vinylcarbazole, vinylthiophene, N-vinylethylacetamide, etc.; styrenes (e.g., styrene, methylstyrene, dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, methoxystyrene, 4-methoxy-3-methylstyrene, dimethoxystyrene, chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, vinyl benzoate, vinyl benzoic acid methyl ester, etc.,); crotonic acids such as crotonic acid, crotonic acid amide, crotonic acid esters (e.g., butyl crotonate, hexyl crotonate, glycerol monocrotonate, etc.,); vinyl ketones (e.g., methyl vinyl ketone, phenyl vinyl ketone, methoxy ethylvinyl ketone, etc.,); olefins (e.g., dicyclopentadiene, ethylene, propylene, 1-butene, 1-pentene, 1-hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,6,6-trimethyl-1-heptene, 1-dodecene, 1-octadecene, etc.,); itaconic acids (e.g., itaconic acid, itaconic anhydride, methyl itaconate, ethyl itaconate, etc.,); crotonic acids (e.g., crotonic acid, methyl crotonate, ethyl crotonate, etc.,); sorbic acid, cinnamic acid, methyl sorbate, glycidyl sorbate, citraconic acid, chloroacrylic acid, mesaconic acid, maleic acid, fumaric acid, ethacrylic acid, halogenated olefins (e.g., vinyl chloride, vinylidene chloride, isoprene, etc.,), unsaturated nitriles (e.g., acrylonitrile, methacrylonitrile, etc.,), etc.

The copolymer may be composed of two or more kinds of the above-described monomers. Examples of such copolymers are a styrene/n-butyl acrylate/acrylic acid copolymer, a styrene/n-butyl acrylate glycidyl acrylate copolymer, etc.

For coating an aqueous dispersion of the polymeric material as described above as a subbing liquid, the aqueous dispersion is further diluted with water, and, if desired, additives such as a crosslinking agent, a surface active agent, a swelling agent, a hydrophilic macromolecular compound, a matting agent, an antistatic agent, an electrolyte, etc., may be added to the aqueous dispersion.

The content of the polymeric material in the subbing liquid is generally from 1 to 20% by weight, and preferably from 2 to 13% by weight.

Crosslinking agents may be used and include, for example, triazine series compounds described in U.S. Pat. Nos. 3,325,287; 3,288,775; 3,549,377; Belgian Patent No. 6,602,226, etc.; dialdehyde series compounds described in U.S. Pat. Nos. 3,291,624; 3,232,764; French Patent No. 1,543,694; U.K. Patent No. 1,270,578; epoxy compounds described in U.S. Pat. No. 3,091,537; Japanese Patent Publication No. 26,580/'74, etc.; vinyl compounds described in U.S. Pat. No. 3,642,486, etc.; aziridine compounds described in U.S. Pat. No. 3,392,024; ethyleneimine compounds described in U.S. Pat. No. 3,549,378, etc., and methylol compounds.

Among these compounds, examples of dichlorotriazine derivatives include dichloro-s-triazine derivatives as shown by the following formulae

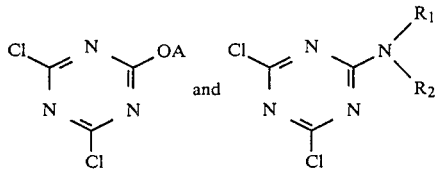

wherein A represents an alkyl group, a cyclic alkyl group, an aryl group, an aralkyl group, a metal atom, or a hydrogen atom; and $R_1$ and $R_2$ each represents a hydrogen atom, an alkyl group, a cyclic alkyl group, an aryl group, an aralkyl group or —$NHR_3$ wherein $R_3$ represents an alkyl group or an acyl group; said $R_1$ and $R_2$ may combine with each other or may form a 5-membered or 6-membered ring containing O, S, or N-$R_4$, wherein $R_4$ represents an alkyl group.

The crosslinking agent may be incorporated in the aqueous dispersion of the polymeric material in an amount of from 0.001 to 200% by weight of the polymeric material.

Practical examples of the crosslinking agent are as follows:

1.

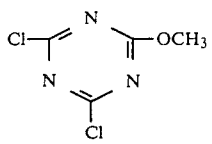

-continued

2.

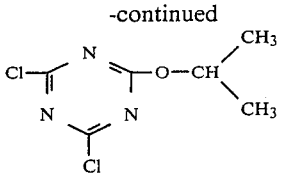

3.

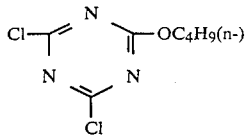

4.

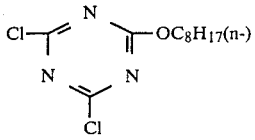

5.

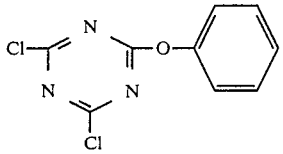

6.

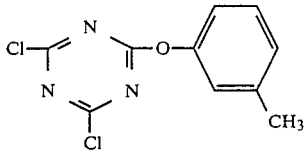

7.

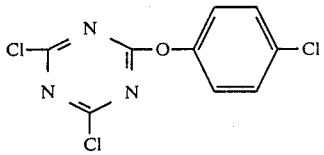

8.

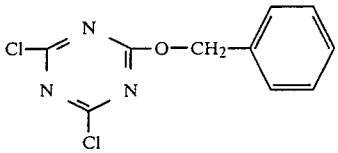

9.

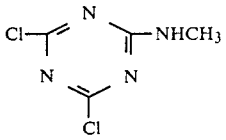

10.

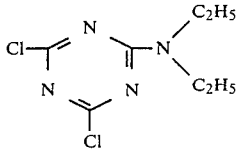

11.

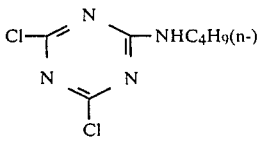

-continued

12.

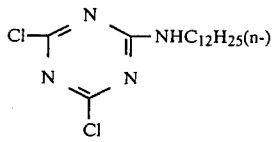

13.

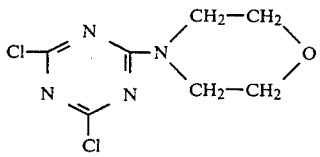

14.

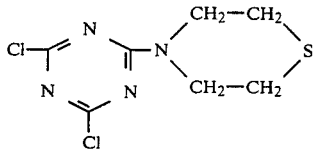

15.

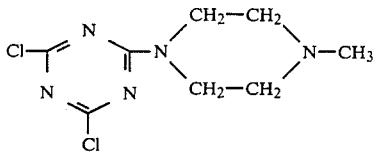

16.

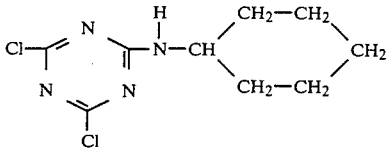

17.

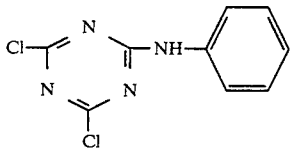

18.

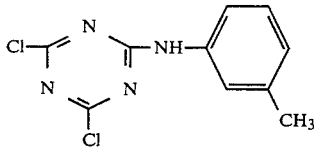

19.

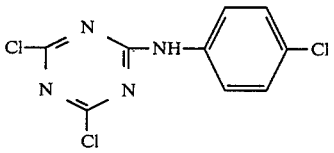

20.

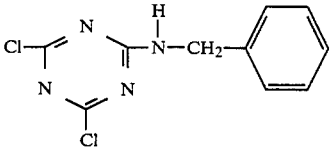

-continued

21.

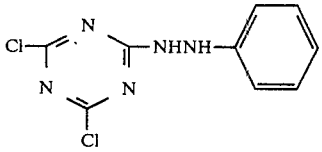

22.

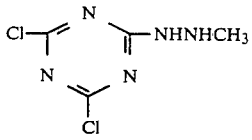

23.

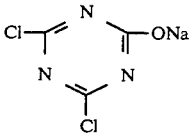

Among these crosslinking agents, 2,4-dichloro-6-hydroxy-s-triazine: sodium salt is particularly preferred.

A swelling agent need not be added to the aqueous dispersion, but if desired, phenol, resorcinol, etc., may be added in an amount of from about 1 to 10 g per liter of the subbing liquid.

As the hydrophilic macromolecular compound, there are natural compounds such as gelatin, etc., and synthetic polymers such as polyvinyl alcohol, a vinyl acetate/maleic anhydride copolymer, an acrylic acid/acrylamide copolymer, a styrene/maleic anhydride copolymer, etc.

As the antistatic agent, there are anionic or cationic surface active agents, ionene series polymers, the maleic acid series copolymers described in Japanese Patent Application (OPI) No. 3972/'74, etc., colloidal silica (e.g., Snow Tex, trademark of a product made by Nissan Chemica Industries, Ltd.), etc.

Examples of the electrolyte are HCl, HBr, $HClO_4$, LiCl, LiBr, LiI, $LiCl_4$, NaCl, NaBr, NaI, $NaClO_4$, $NaNO_3$, NaOH, KCl, KBr, KI, $KNO_3$, $NH_4Cl$, RbCl, RbBr, RbI, $MgCl_2$, $MgBr_2$, $MgI_2$, $CaCl_2$, $CaBr_2$, $CaI_2$, $Ca(ClO_4)_2$, $SrCl_2$, $Sr(ClO_4)_2$, $BaCl_2$, $BaBr_2$, $BaI_2$, $AlCl_3$, $LaCl_3$, $Zn(ClO_4)_2$, etc.

The electrolyte can also exhibit an antistatic effect and the addition amount thereof is from 0.001 mg to 100 $mg/m^2$, and preferably from 0.1 mg to 10 $mg/m^2$.

Although according to this invention blocking can be prevented without using a matting agent, for purposes other (e.g., reduction of slipping property, etc.,) than blocking prevention, a matting agent may be used in the first subbing layer containing the above-described copolymer and/or in the second subbing layer in this invention.

The coating compositions for the first subbing layer and the second subbing layer in this invention can be coated by a coating method generally known in the art, such as a dip coating method, an air knife coating method, a curtain coating method, a roller coating method, a wire bar coating method, a gravure coating method, and an extrusion coating method using the hopper described in U.S. Pat. No. 2,681,294. If desired, two or more layers can be simultaneously coated by the method described in U.S. Pat. Nos. 2,761,791; 3,508,947; 2,941,898; and 3,526,528; and Hitoshi Ozaki, *Coating Kogaku* (*Coating Engineering,* pages 253 (published by Asakura Shoten, 1973).

The coating amount of the polymeric material in the first subbing layer in this invention is generally from 0.01 to 10 g, and preferably from 0.2 to 3 g (solids content) per square meter of the support.

Then, the second subbing liquid which is an important portion of this invention is described.

It is preferred that the second subbing liquid in this invention contains a hydrophilic macromolecular compound capable of strongly adhering to the first subbing layer described above and a photographic silver halide emulsion layer described below as a binder. When the second subbing liquid contains the binder, the subbing liquid contains methyl cellulose in an amount of from about 1% to 99%, and preferably from about 2% to 50%, and more preferably from about 3% to 30% by weight, based on the weight of the binder.

When the substitution degree of the methyl cellulose is from 0 to 2.5, preferably from 0.5 to 2.5, and more preferably from 1.0 to 2.5, excellent anti-blocking effect is obtained. If the degree of substitution is over 2.5, the objects of this invention are not attained. The polymerization degree of methyl cellulose can be properly selected from the relation between the coating method employed and the viscosity of the subbing liquid containing the methyl cellulose, preferably being 70 to 800. One of the striking features of this invention is the discovery that by using methyl cellulose having a degree of substitution in the specific range, vig. less than 2.5 among various cellulose derivatives as water-soluble macromolecular compounds, the objects of this invention are effectively attained. In particular, the use of the methyl cellulose defined in this invention is very effective for the prevention of the occurrence of blocking in the case of incorporating an electrolyte in the first subbing layer. The "degree of substitution" is disclosed in A. B. Savage, *Encyclopedia of Polymer Science and Technology* Vol. 3, P. 460 and 509 published by Interscience Publishers a Division of John Wiley & Son, Inc. (1965).

Into the methyl cellulose which is used in this invention may be introduced an etherified or esterified group other than a methoxy group, such as hydroxypropyl group or may be introduced a carboxybenzyl group, etc.

Such methyl celluloses are commercially available, e.g., from Shin-Etsu Chemical Co., Ltd., under the trademarks of Metrose SM-15, Metrose 60SH-50, Metrose 60SH-4000, Meterose 65SH-50, and Metrose 90SH-100. Synthesis methods and properties of these products are described in detail, e.g., in the product catalogue "Metrose" of Shin-Etsu Chemical Co., Ltd., and in *Cellulose and Cellulose Derivatives, Nos.* 1 to 5, Ott, E et al., on the same company.

Examples of methods for producing the methyl cellulose include a method of methylating cellulose with an aqueous solution of from 18 to 35% sodium hydroxide and dimethyl sulfate, and repeating the methylation in order to obtain a highly methylated sample and a method of reacting an alkali cellulose and methyl chloride in an autoclave.

In another embodiment of this invention, the second subbing liquid contains water-soluble polyvinyl alcohol having a degree of hydrolysis of lower than 97 mole% in place of the above-described water-soluble methyl cellulose. When the second subbing liquid contains a hydrophilic macromolecular compound as a binder, the subbing liquid contains the water-soluble polyvinyl alcohol in an amount of from about 1 to 99% by weight, preferably from 5 to 50% by weight, and more preferably from 10 to 30% by weight, based on the weight of the binder.

As to the hydrolysis of polyvinyl alcohol, polyvinyl alcohol having a degree of hydrolysis of about 60 to 97 mole%, preferably about 70 to 95 mole%, and more preferably about 83 to 93 mole% provides an excellent antiblocking effect, whereas and so-called completely hydrolyzed polyvinyl alcohol having a degree of hydrolysis of higher than 98 mole% does not give sufficient antiblocking effect.

The "degree of hydrolysis" is disclosed in A. B. Savage, *Encyclopedia of Polymer Science and Technology,* Vol. 14, P. 169, published by Interscience Publishers a Division of John Wiley & Sons, Inc. (1965), and in *Bunseki Kagaku Binran,* P. 984, edited by Nippon Bunseki Kagakukai (1981).

The polymerization of polyvinyl alcohol can be suitably selected from the relation between the coating method and the viscosity. Preferable polymerization degree is 300 to 2400.

The striking feature of the embodiment of this invention is the discovery that when specific polyvinyl alcohol which is water-soluble and has a degree of hydrolysis degree of lower than 97 mole% is used for second subbing layer, the objects of this invention can be effectively attained. However, a completely hydrolyzed polyvinyl alcohol, which is usually what is meant when the expression "polyvinyl alcohol" is used, cannot achieve the objects of this invention. In particular, when the polyvinyl alcohol as defined in this invention is used, remarkable antiblocking effect is obtained in the case that the first subbing layer contains an electrolyte.

The polyvinyl alcohol having the degree of hydrolysis as defined in this invention is commercially available under the trademarks PVA-203, PVA-204, PVA-205, PVA-210, PVA-217, PVA-220, PVA-224, PVA-217EE, PVA-217E, PVA-220E, PVA-224E, PVA-405, PVA-420, PVA-613, and L-8, all made by KURARAY Co., Ltd.

The synthesis methods and properties of these products are described in the product catalogue "*KURARAY Poval*" of KURARAY Co., Ltd., and in "*Poval*" published by Kobunshi Kanko-Kai (1981).

Examples of the natural and synthetic hydrophilic macromolecular compound which is used for the second subbing liquid together with the above-described water-soluble methyl cellulose or water-soluble polyvinyl alcohol include gelatin; acylated gelatin such as phthalated gelatin, maleated gelatin, etc.; cellulose derivatives such as carboxymethyl cellulose, hydroxyethyl cellulose, etc.; graft gelatin such as gelatin grafted with acrylic acid, methacrylic acid, an amide, etc.; polyhydroxyalkyl acrylate; polyvinylpyrrolidone; copolyvinylpyrrolidone-vinyl acetate; casein; agarose; albumin; sodium alginate; polysaccharide; agar agar; starch; grafted starch; polyacrylamide; polyethyleneimine-acrylates; and the homopolymers or copolymers of acrylic acid, methacrylic acid, acrylamide, N-substituted acrylamide, N-substituted methacrylamide, or partially hydrolyzed products of them, etc. They can be used solely or as a mixture of them.

Preferred examples of the hydrophilic macromolecular compounds are gelatin and gelatin derivatives.

The coating composition for the second subbing layer containing the above-described hydrophilic macromolecular compound as a binder together with the above-described water-soluble methyl cellulose having a degree of substitution of less than 2.5 or water-soluble polyvinyl alcohol having a degree of hydrolysis of lower than 97 mole% may further contain any desired additives, such as an antistatic agent, a crosslinking agent, etc.

The photographic layers which are used in this invention are explained below.

The binder (hydrophilic organic protective colloid) for the photographic layers may include natural or synthetic hydrophilic macromolecular compounds, for example, gelatin; acylated gelatin such as phthalated gelatin, maleated gelatin, etc.; cellulose derivatives such as carboxymethyl cellulose, hydroxyethyl cellulose, etc.; graft gelatin such as gelatin grafted with acrylic acid, methacrylic acid or an amide; polyvinyl alcohol, polyhydroxyalkyl acrylate, polyvinylpyrrolidone, copolyvinylpyrrolidone-vinyl acetate; casein; agarose, albumin; sodium alginate; polysaccharide; agar-agar; starch; graft starch; polyacrylamide; polyethyleneimine acylate; and homopolymers or copolymers of acrylic acid, methacrylic acid, acrylamide, N-substituted acrylamide, N-substituted methacrylamide, etc., or partially hydrolyzed products of them. They may be used solely or as a mixture thereof.

The photographic layers containing the above-described hydrophilic macromolecular compounds as the binder may contain various additives such as physical development nuclei such as silver halide or silver sulfide used for a diffusion transfer photographic process, diazo compounds as well as couplers, emulsifiers, latex polymers, etc.

In addition, a surface treatment such as corona discharging treatment, etc., may be applied onto the hydrophobic support, the first subbing layer and/or the second subbing layer although the treatment is not always necessary in this invention and in this case the adhesive property of the support or the layer thus treated can be improved.

The invention is further illustrated by examples below, although the invention is not limited to the embodiments described in these examples.

Before describing the examples, the test procedures employed in these examples are first described.

Evaluation of blocking:

After allowing a subbed film to stand for 3 hours under the atmosphere of 23° C.±3° C. and 80±5% RH, the film is cut into a size of 35 mm×35 mm. Five groups of two such cut films were superposed with each other and allowed to stand for 21 hours under the same atmosphere as above under a load of 84 kg. Then, the films are separated from each other and the blocking area is measured. With one frame being 3.5 mm×3.5 mm, the number of frames forwhich blocking occurs for 100 frames is measured and the blocking extent is evaluated as ranks A to E according to the number of frames causing blocking. The value is shown by a mean value of five groups. The rank is defined to Class A when the number of the frames blocked is 0 to 5, Class B when the number is 5 to 10, Class C when the number of 10 to 20, Class D when the number is 20 to 30, and Class E when the number is greater then 30.

If the film is in Class A or Class B, the film can be practically used as a support for photographic products. The films in Class C to D exhibit blocking depending on the drying condition at coating, the winding condition of the film base, and the storing condition of the film support. The films in Class E cause severe blocking.

Evaluation of the adhesion between film support and silver halide emulsion layer:

The adhesive strength test after coating a silver halide emulsion on the film support having the subbing layer and after processing the photographic film (development, fix, wash) is performed as follows. Six cuts with an interval of 3 to 5 mm were formed in the silver halide emulsion layer crosswise by means of a knife to form 5×5 squares, an adhesive tape is attached thereto followed by peeling off, and the number of the squares of the emulsion layer separated from the support is measured. In this case, the photographic film is evaluated to Class A when the number of the squares is 0, Class A′ when the number of 1 to 2, Class B when the number is 3 to 4, and Class C when the number is larger than 4.

The adhesive strength test in a processing solution is performed as follows. The edge portion of a base film having a silver halide emulsion layer formed thereon is strongly rubbed 15 times by a finger in a processing solution and the film is evaluated to Class A when the length of the separated emulsion layer from the edge is 0 mm, Class A′ when the length is 1 to 2 mm, Class B when the length is 2 to 4 mm, and Class C when the length is longer than 4 mm.

The above test was performed using a developer, LDS-715 (made by Fuji Photo Film Co., Ltd.) and a fix solution, LF-308 (made by Fuji Photo Film Co., Ltd.) as the processing solution by a dish development process.

In these evaluation methods, the films in Classes A to A′ can be used as photographic materials.

EXAMPLE 1

Corona discharging treatment was applied onto a biaxially stretched polyethylene film of 100 microns in thickness, and a first subbing liquid having the following composition was coated thereon at a coverage of about 6 ml/m$^2$ by means of a wire bar coater followed by drying for one minute at 140° C. Then, the other side of the film was also coated with the first subbing liquid in the same manner.

Butadiene-styrene Copolymer Latex (solid content 43% and weight ratio of butadiene/-styrene=32/68): 13 ml
2,4-Dichloro-6-hydroxy-s-triazine Sodium Salt (3% solution): 7 ml
Sodium Laurylbenzenesulfonate (1% solution): 1.6 ml
Distilled Water: 80 ml On each of the first subbing layers of both the surfaces of the support was coated each of the second subbing liquids 1 to 7 having the following composition at a coverage of about 9 ml/m$^2$, respectively and dried to provide 7 kinds of coated films (subbed supports).

Second Subbing Composition 1:
Gelatin: 0.7 g
Methyl Cellulose (Metrose SM-15, Degree of Substitution 1.79–1.83): 0.3 g
Acetic Acid (Concentration 99%): 0.02 ml
Distilled Water: 99 ml Second Subbing Composition 2:
Gelatin: 0.9 g
Methyl Cellulose (Metrose SM-15, Degree of Substitution of 1.79–1.83): 0.1 g
Acetic Acid (concentration 99%): 0.02 ml
Distilled Water: 99 ml Second Subbing Composition 3:
Gelatin: 0.9 g
Methyl Cellulose (degree of substitution 2.6): 0.1 g Acetic Acid (concentration 99%): 0.02 ml
Methanol: 30 ml
Distilled Water: 69 ml Second Subbing Composition 4:
Gelatin: 0.7 g
Methyl Cellulose (degree of substitution 2.6): 0.3 g
Acetic Acid (concentration 99%): 0.02 ml
Methanol: 30 ml
Distilled Water: 69 ml Second Subbing Composition 5:
Gelatin: 0.9 g
Methyl Cellulose (degree of substitution 0.8): 0.1 g
Sodium Hydroxide: 0.2 g
Distilled Water: 99 ml Second Subbing Composition 6:
Gelatin: 0.7 g
Methyl Cellulose (degree of substitution 0.8): 0.3 g
Sodium Hydroxide: 0.2 g
Distilled Water: 99 ml Second Subbing Composition 7:
Gelatin: 1 g
Acetic Acid (concentration 99%): 0.02 ml
Distilled Water: 99 ml Thus 7 kinds of coated films having the first subbing layer and the second subbing layer on both the surfaces thereof were prepared and on these films, the evaluation of blocking was performed. The results thus obtained are shown in Table 1 below.

Then, one side of each of 7 kinds of the coated films thus obtained was coated with silver halide emulsion having the following composition (1) at a silver coverage of 5.0 g/m$^2$. Furthermore, on the silver halide emulsion layer was coated a protective layer having the following composition (2), and the opposite side of the support was coated with a gelatin backing layer having the following composition (3) to provide a dry thickness of 5 microns. Thus 7 kinds of photographic light-sensitive materials were prepared.

| Composition (1): Composition of silver halide emulsion layer: | |
|---|---|
| Gelatin | 5 g/m$^2$ |
| Silver Iodobromide (Cl: 80 mol %, Br: 19.5 mol %, and I: 0.5 mol %) | |
| Chloroauric Acid | 0.1 mg/m$^2$ |
| Polyethylacrylate Latex (same as that used in Example 3 of U.S. Pat. No. 3,525,620) | 1.5 g/m$^2$ |
| Sensitizing Dye: 3-Allyl-5-[2-(1-ethyl)-4-methyl-2-tetrazolin-5-ilidene-ethylidene]-rhodanine | 6 mg/m$^2$ |
| Antifoggant: 4-Hydroxy-6-methyl-1,3,3a-7-tetraazaindene | 30 mg/m$^2$ |
| Polyoxyethylene Compound of the Formula | 20 mg/m$^2$ |

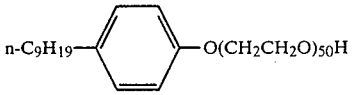

| | |
|---|---|
| Gelatin Hardener: 2-Hydroxy-4,6-dichloro-s-triazine.Sodium Salt | 60 mg/m$^2$ |
| Surface Active Agent: Sodium p-Dodecylbenzenesulfonate | 40 mg/m$^2$ |

| Composition (2): Composition of protective layer: | |
|---|---|
| Gelatin | 1 g/m$^2$ |
| Matting Agent: Polymethyl Methacrylate having mean particle size of 3.0–4.0 | 0.05 g/m$^2$ |
| Surface Active Agent: Sodium p-Dodecylbenzenesulfonate | 0.03 g/m$^2$ |

-continued

| | |
|---|---|
| Gelatin Hardener: 2-Hydroxy-4,6-dichloro-s-triazine.Sodium Salt | 0.01 g/m$^2$ |

| Composition (3): Composition of backing layer: | |
|---|---|
| Gelatin | shown in Table 1 |
| Gelatin Hardener | |
| Matting Agent* | 0.03 g/m$^2$ |
| Polymer Latex** | 50 g/100 g-gelatin |
| Dye*** | 0.3 g/m$^2$. |

*Same as used in the protective layer.
**Same as used in the silver halide emulsion layer.
***Mixture of following dyes (1), (2) and (3) of 1:1:1.

(1)

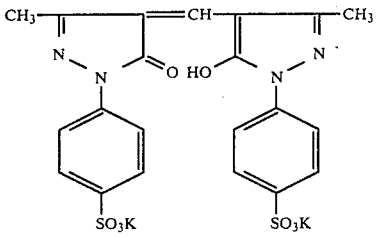

(2)

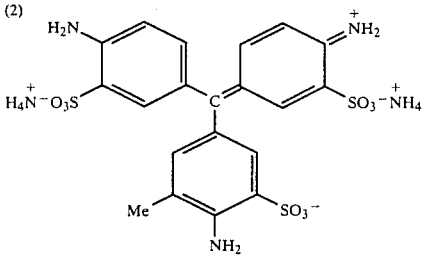

(3)

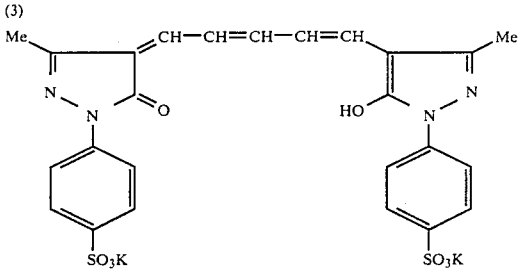

For the 7 kinds of the photographic light-sensitive materials thus obtained, the evaluation of the adhesive property between the film support and the silver halide emulsion layer was performed, and the results are shown in Table 1.

TABLE 1

| Composition of Second Subbing Liquid | Blocking | Adhesion: After Coating Emulsion | Adhesion: During Processing (Fix) | Adhesion: After Processing |
|---|---|---|---|---|
| No. 1 | A | A | A | A |
| No. 2 | A | A | A | A |
| No. 3 | E | A | A | A |
| No. 4 | E | A | A | A |
| No. 5 | B | A | A | A |
| No. 6 | A | A | A | A |
| No. 7 | E | A | A | A |

The results of the blocking evaluation show that the coated films using the methyl cellulose of this invention have an excellent antiblocking property. These film bases having good antiblocking property also show good antiblocking property, after coating thereon the silver halide emulsion layer and the backing layer, in the surfaces with each other. The coated films thus obtained in this invention have no adverse influences on the adhesion with the silver halide emulsion layer, the photographic properties, or transparency.

EXAMPLE 2

By following the same procedure as in Example 1 except that following second coating compositions 8 to 14 were used in place of the second subbing compositions 1 to 7, 7 kinds of the coated films (subbed supports) were prepared.

Second Subbing Composition 8:
- Gelatin: 0.7 g
- Polyvinyl Alcohol (PVA-204, having degree of hydrolysis 88 mole%, trade name, made by KURARAY Co., Ltd.): 0.3 g
- Acetic Acid (concentration 99%): 0.02 ml
- Distilled Water: 99 ml Second Subbing Composition 9:
- Gelatin: 0.9 g
- Polyvinyl Alcohol (PVA-204, same as above): 0.1 g
- Acetic Acid (concentration 99%): 0.02 ml
- Distilled Water: 99 ml Second Subbing Composition 10:
- Gelatin: 0.9 g
- Polyvinyl Alcohol (PVA-105, having degree of hydrolysis 98 mole%, trade name, made by KURARAY): 0.1 g
- Acetic Acid (concentration 99%): 0.02 ml
- Distilled Water: 99 ml Second Subbing Composition 11:
- Gelatin: 0.7 g
- Polyvinyl Alcohol (PVA-105, same as above): 0.3 g
- Acetic Acid (concentration 99%): 0.02 ml
- Distilled Water: 99 ml Second Subbing Composition 12:
- Gelatin: 0.9 g
- Polyvinyl Alcohol (L-7, having degree of hydrolysis 68.2 mole%, trade name, made by KURARAY): 0.1 g
- Acetic Acid (concentration of 99%): 0.02 ml
- Distilled Water: 99 ml Second Subbing Composition 13:
- Gelatin: 0.7 g
- Polyvinyl Alcohol (L-7, same as above): 0.3 g
- Acetic Acid (concentration 99%): 0.02 ml
- Distilled Water: 99 ml Second Subbing Composition 14:
- Gelatin: 1 g
- Acetic Acid (concentration 99%): 0.02 ml
- Distilled Water: 99 ml For the 7 kinds of the coated films having the first subbing layers and the second subbing layers on both the surfaces of each film, the evaluation of blocking was performed. The results thus obtained are shown in Table 2.

Then, one side of each of 7 kinds of the coated films thus obtained was coated with the silver halide emulsion of the composition (1) as in Example 1 at a dry thickness of 6.0 microns and a silver coverage of 5.0 g/m$^2$. Furthermore, a protective layer having the same composition as the protective layer (2) in Example 1 was formed on the silver halide emulsion layer and the opposite side thereof was coated with the composition (3) for the gelatin backing layer as in Example 1 to provide a dry thickness of 5 microns. Thus 7 kinds of photographic light-sensitive materials were prepared.

For the photographic light-sensitive materials thus obtained, the evaluation of the adhesion between the film support and the silver halide emulsion layer was performed, the results are shown in Table 2.

TABLE 2

| Composition of Second Subbing Liquid | Blocking | Adhesion: After Coating Emulsion | Adhesion: During Processing (Fix) | Adhesion: After Processing |
|---|---|---|---|---|
| No. 8 | A | A | A | A |
| No. 9 | A | A | A | A |
| No. 10 | E | A | A | A |
| No. 11 | E | A | A | A |
| No. 12 | B | A | A | A |
| No. 13 | A | A | A | A |
| No. 14 | E | A | A | A |

The results of the blocking evaluation show that the coated films using the polyvinyl alcohol of this invention are excellent in antiblocking property. These films bases having good antiblocking property also show a good antiblocking property after coating thereon the silver halide emulsion layer and the backing layer, in the surface which contact each other. The coated films thus obtained in this invention have no adverse influences on the adhesion with the silver halide emulsion layer, the photographic properties, or transparency.

EXAMPLE 3

A corona discharging treatment was applied onto a biaxially stretched polyethylene terephthalate film of 100 microns in thickness and the first subbing liquid having the following composition was coated at a coverage of about 6 ml/m$^2$ and dried to form a first subbing layer of about 0.2 to 0.4 micro, in thickness. A first subbing layer was also formed on the opposite side of the support by the same manner as above.

| | |
|---|---|
| Butadiene-Styrene Copolymer Latex (solid content 43%, butadiene/styrene = 32/68 by weight ratio) | 13 ml |
| Vinylsulfone Compound having the formula | 0.5 g |

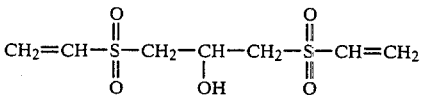

| | |
|---|---|
| Sodium Laurylbenzenesulfonate (1% aqueous solution) | 1.6 ml |
| Aqueous Solution of 1% Sodium Chloride | 5 ml |

On each of the first subbing layers coated at both surfaces of the support was coated each of the subbing liquids 1 to 7 as used in Example 1, followed by drying to provide 7 kinds of the coated films and each of the coated film was subjected to the blocking test as in Example 1. Furthermore, a silver halide emulsion layer, a protective layer, and a blocking layer were formed on each of the coated films as in Example 1 to provide a photographic materials and the adhesion of the film support and the silver halide photographic emulsion layer was evaluated on each sample. These results are shown in Table 3.

TABLE 3

| Composition of Second Subbing Liquid | Blocking | Adhesion After Coating Emulsion | During Processing (Fix) | After Processing |
|---|---|---|---|---|
| No. 1 | A | A | A | A |
| No. 2 | A | A | A | A |
| No. 3 | E | A | A | A |
| No. 4 | E | A | A | A |
| No. 5 | B | A | A | A |
| No. 6 | A | A | A | A |
| No. 7 | E | A | A | A |

The results of the blocking evaluation show that the coated films using the methyl cellulose of this invention are excellent in antiblocking property. Also, the coated films obtained according to this invention have no adverse influences on the adhesion with silver halide emulsion layers, the photographic properties, or transparency.

EXAMPLE 4

A corona discharging treatment was applied onto a biaxially stretched polyethylene terephthalate film of 100 microns in thickness and a first subbing liquid having the following composition was coated thereon at a coverage of about 6 ml/m$^2$ and dried to form a first subbing layer of about 0.2 to 0.4 micron in thickness. Also, a first subbing layer was also formed on the opposite surface of the support in the same manner as above.

Butadiene-Styrene Copolymer Latex (solid content 43%, butadiene/styrene=32/68 by weight ratio): 13 ml Vinylsulfone Compound Having the Same Structure as in Example 3: 0.5 g Sodium Laurylbenzenesulfonate (1% aqueous solution): 1.6 ml Aqueous Solution of 1% Sodium Chloride: 5 ml On each of the subbing layers formed on both surfaces of the support was coated each of the second subbing liquids 8 to 14 as used in Example 2 and dried to provide 7 kinds of coated films. Each of the coated films was subjected to the blocking test as in Example 1. Furthermore, a silver halide photographic emulsion layer, a protective layer and a backing layer were formed on each of the coated films as in Example 1 and the adhesion between the film support and the silver halide photographic emulsion layer was evaluated on each sample. These results are shown in Table 4.

TABLE 4

| Composition of Second Subbing Liquid | Blocking | Adhesion After Coating Emulsion | During Processing (Fix) | After Processing |
|---|---|---|---|---|
| No. 8 | A | A | A | A |
| No. 9 | A | A | A | A |
| No. 10 | E | A | A | A |
| No. 11 | E | A | A | A |
| No. 12 | B | A | A | A |
| No. 13 | A | A | A | A |
| No. 14 | E | A | A | A |

The results of the blocking evaluation show that the coated films using the polyvinyl alcohol of this invention are excellent in antiblocking property. Also, the coated films of this invention have no adverse influences on the adhesion with the silver halide emulsion layer, the photographic properties, or transparency.

EXAMPLE 5

By following the same procedure as in Example 3, 7 kinds of coated films each having a first subbing layer and a second subbing layer on both surfaces thereof were obtained, in this case, however, sodium chloride was not used in the first subbing liquids.

By following the same procedure as in Example 1 using the coated films thus obtained, 7 kinds of photographic materials were prepared.

Then, about each of the coated films, the blocking test and the evaluation of adhesion with a silver halide photographic material were performed as in Example 1 and the results thus obtained are shown in Table 5.

TABLE 5

| Composition of Second Subbing Liquid | Blocking | Adhesion After Coating Emulsion | During Processing (Fix) | After Processing |
|---|---|---|---|---|
| No. 1 | A | A | A | A |
| No. 2 | A | A | A | A |
| No. 3 | C | A | A | A |
| No. 4 | C | A | A | A |
| No. 5 | A | A | A | A |
| No. 6 | A | A | A | A |
| No. 7 | C | A | A | A |

The results of the blocking evaluation show that the coated films using the polyvinyl alcohols of this invention are excellent in antiblocking property. Also, the coated films of this invention have no adverse influences on the adhesion with the silver halide emulsion layers, the photographic properties, or haze of the photographic emulsion layers.

EXAMPLE 6

By following the same procedure as in Example 4, 7 kinds of coated films each having a first subbing layer and a second subbing layer on both surfaces thereof were obtained, in this case, however, sodium chloride was not used in the first subbing liquids.

By following the same procedure as in Example 2 using the coated films thus obtained, 7 kinds of photographic materials were prepared.

Then, about each of the coated films, the blocking test and the evaluation of adhesion with a silver halide photographic material were performed as in Example 1 and the results thus obtained are shown in Table 6.

TABLE 6

| Composition of Second Subbing Liquid | Blocking | Adhesion After Coating Emulsion | During Processing (Fix) | After Processing |
|---|---|---|---|---|
| No. 8 | A | A | A | A |
| No. 9 | A | A | A | A |
| No. 10 | C | A | A | A |
| No. 11 | C | A | A | A |
| No. 12 | A | A | A | A |
| No. 13 | A | A | A | A |
| No. 14 | C | A | A | A |

The results of the blocking evaluation show that the coated films using the polyvinyl alcohols of this invention are excellent in antiblocking property. Also, the coated films of this invention have no adverse influences on the adhesion with the silver halide emulsion layers, the photographic properties, or transparency.

While the invention has been described in detail and with reference to specific embodiments thereof, it will be apparent to one skilled in the art that various changes and modifications can be made therein without departing from the spirit and scope thereof.

What is claimed is:

1. A photographic material comprising hydrophobic support having thereon at least one silver halide emulsion layer, a first subbing layer composed of a copolymer of a dienic monomer, and a second subbing layer comprising a hydrophilic layer containng gelatin and water-soluble methyl cellulose having a degree of substitution of 0.5 to 2.6 or gelatin and water-soluble polyvinyl alcohol having a degree of hydrolysis of 60 to 97 mole % on the first subbing layer, wherein said copolymer, said methyl cellulose and said polyvinyl alcohol are added in amounts sufficient to prevent blocking of photographic materials.

2. A photographic material as in claim 1, wherein the copolymer is a copolymer of a dienic monomer having from 4 to 8 carbon atoms.

3. A photographic material as in claim 1, wherein the first subbing layer contains a cross-linking agent.

4. A photographic material as in claim 3, wherein the cross-linking agent is a dichlorotriazine derivative.

5. A photographic material as in claim 3, wherein the amount of the cross-linking agent is 0.001 to 200% by weight based on the weight of the copolymer of a dienic monomer.

6. A photographic material as in claim 2, wherein the copolymer is a copolymer of a dienic monomer having from 4 to 8 carbon atoms and is copolymerized with a vinyl or vinylidene compound having from 2 to 8 carbon atoms.

7. A photographic material as in claim 1, wherein the copolymer of a dienic monomer has a glass transition temperature in the range of from −20° C. to 40° C.

8. A photographic material as in claim 2, wherein the proportion of the diene component in the copolymer is from about 30 to 60% by weight based on the total weight of the copolymer.

9. A photographic material as in claim 2, wherein the proportion of the diene component in the copolymer is from about 30 to 40% by weight based on the total weight of the copolymer.

10. A photographic material as in claim 2, wherein the coating amount of the copolymer in the first subbing layer is from 0.01 to 10 g/m$^2$ of the support.

11. A photographic material as in claim 2, wherein the coating amount of the copolymer in the first subbing layer is from 0.2 to 3 g/m$^2$ of the support.

12. A photographic material as in claim 1, wherein the second subbing layer contains methyl cellulose in an amount of from about 1% to 99% by weight based on the weight of the binder.

13. A photographic material as in claim 1, wherein the second subbing layer contains methyl cellulose in an amount of from about 3% to 30% by weight based on the weight of the binder.

14. A photographic material as in claim 1, wherein the second subbing layer contains a hydrophilic macromolecular binder, and the methyl cellulose is present in an amount of from about 3% to 30% by weight based on the weight of the binder.

15. A photographic material as in claim 1, wherein the second subbing layer contains water-soluble polyvinyl alcohol in an amount of from about 1 to 99% by weight, based on the weight of the binder.

16. A photographic material as in claim 1, wherein the second subbing layer contains water-soluble polyvinyl alcohol in amount of from about 5 to 50% by weight, based on the weight of the binder.

17. A photographic material as in claim 1, wherein the second subbing layer contains a hydrophilic macromolecular binder, and the water-soluble polyvinyl alcohol in an amount of from about 10 to 30% by weight, based on the weight of the binder.

18. A photographic material as in claim 1, wherein the degree of hydrolysis, of the water-soluble polyvinyl alcohol is from 70 to 95 mole %.

19. A photographic material as in claim 1, wherein the degree of hydrolysis of the water-soluble polyvinyl alcohol is from 83 to 93 mole %.

* * * * *